US006136102A

United States Patent [19]

Davidson

[11] Patent Number: 6,136,102

[45] Date of Patent: Oct. 24, 2000

[54] MARAGING STEEL

[75] Inventor: James Davidson, Varennes-Vauzelles, France

[73] Assignee: Imphy Ugine Pricision, Pateaux, France

[21] Appl. No.: 09/243,492

[22] Filed: Feb. 3, 1999

[30] Foreign Application Priority Data

Feb. 4, 1998 [FR] France ..... 98 01241

[51] Int. Cl.[7] ..... C22C 38/00

[52] U.S. Cl. ..... 148/328; 148/336; 148/505; 148/540; 420/96

[58] Field of Search ..... 148/328, 336, 148/337, 540, 505; 420/96

[56] References Cited

U.S. PATENT DOCUMENTS

| | | | |
|---|---|---|---|
| 3,123,506 | 3/1964 | Tanezyn | 148/328 |
| 3,152,934 | 10/1964 | Lula et al. | 148/328 |
| 3,392,065 | 7/1968 | Bieber et al. | 148/328 |

FOREIGN PATENT DOCUMENTS

| | | |
|---|---|---|
| 0 051 401 | 5/1983 | European Pat. Off. . |
| 0 105 864 | 4/1984 | European Pat. Off. . |
| 0 327 042 | 8/1989 | European Pat. Off. . |
| 2 127 799 | 10/1972 | France . |

*Primary Examiner*—Sikyin Ip
*Attorney, Agent, or Firm*—Oblon, Spivak, McClelland, Maier & Neustadt, P.C.

[57] ABSTRACT

A maraging steel containing the following: Ni 14–23 wt. %, Mo 4–13 wt. %, Al 1–3.5 wt. %, C≦0.01 wt. %, remainder Fe and impurities resulting from the processing. The composition also preferably satisfies the following conditions:

Ni+Mo=23–27 wt. %, inclusively;

Ni+2.5×Mo+2.3×Al≧38 wt. %.

14 Claims, No Drawings

MARAGING STEEL

BACKGROUND OF THE INVENTION

1. Field of the Invention

The invention relates to a maraging steel. The invention steel preferably contains no cobalt or titanium, and has a high elastic limit and good resistance to fatigue.

2. Background of the Invention

Maraging steels are self-tempering steels which can acquire a soft martensitic structure by cooling in air, which structure can be appreciably hardened by a thermal aging treatment which gives rise to formation of intermetallic precipitates. In essence, these steels contain:

10–30 wt. % nickel, which enables one to obtain a martensitic structure by cooling in air;

a low carbon content which enables one to obtain a soft martensite; and additional elements which enable hardening by formation of intermetallic precipitates, said elements being namely titanium, aluminum, and molybdenum, as well as cobalt, where the presence of the cobalt enhances the effects of the other added elements.

One may also add niobium, to fix the carbon and thereby soften the un-aged martensitic structure.

These steels were devised in the face of the problem of simultaneously obtaining a very high limit of elasticity and good ductility. Initially, good ductility was obtained by simultaneous addition of cobalt and molybdenum. However, cobalt as an alloying element is costly and not available from a reliable source of supply. In order to avoid the constraints imposed by cobalt, maraging steels without cobalt were developed which contain:

Ni 17–26 wt. %, Mo 0.2–4 wt. %, Ti 1–2.5 wt. %,

Al<1 wt. %, and optionally some Nb, with the remainder being Fe and impurities resulting from the processing. Such steels are described, e.g., in Brit. Pat. 1,355,475 and U.S. Pat. No. 4,443,254; both incorporated herein by reference. They enable one to obtain a high tensile strength (on the order of 1800 MPa) and satisfactory ductility, in a metal which is homogenized at elevated temperature followed by cooling and aging.

OBJECTS OF THE INVENTION

For certain applications it is desirable to obtain a maraging steel with an elastic limit above 1900 MPa, such as >1900 MPa, 1950 MPa, 2000 MPa, etc. with elongation at failure of >4%, as well as good resistance to fatigue. In such instances, it is desirable that the steel not contain titanium. In practice, in processing, the steel will always acquire a small amount of nitrogen, which form nitrides with titanium; such nitrides are detrimental to good fatigue resistance. The present invention maraging steel provides the properties set forth above.

DETAILED DESCRIPTION OF THE INVENTION

The steel which accomplishes the above object is a maraging steel, which steel comprises, consists of, or consists essentially of the following chemical composition:

Ni 14–23 wt. %, Mo 4–13 wt. %,

Al 1–3.5 wt. %, C≦0.01 wt. %, (all based on total weight), iron and impurities resulting from the processing;

where the composition preferably also satisfies the following conditions:

Ni+Mo=23–27 wt. %;

Ni+2.5×Mo+2.3×Al≧38 wt. %. Preferably, the steel contains no added cobalt, but cobalt may be present in small quantities as an impurity, generally preferably in amounts less than 0.2 wt. %. Also preferably, the steel contains no titanium.

The invention steel preferably has a limit of elasticity, Re, ≧1900 MPa, and elongation at failure ≧4% for steel which has been solution heat-treated at >8020 C. followed by aging; or which has been cold rolled (or otherwise reduced in thickness by cold working) followed directly by aging, the cold rolling (or other cold-working) reduction in thickness being in the range 0–30%.

The invention will be further described in more detail hereinbelow, and will be illustrated in the form of examples.

The invention maraging steel comprises, consists of, or consists essentially of:

Ni 14–23 wt. %, preferably >16 wt. %, and

Mo 4–13 wt. %, preferably 5–8 wt. %.

The preferred ranges enable the desired mechanical characteristics to be achieved more economically. Because the cost of molybdenum is 2–4 times that of nickel, it is preferable to use more nickel and less molybdenum. Further, the following constraints should preferably hold:

Ni+Mo=23–27 wt. %, preferably 24–26 wt. %.

In the invention steels it is preferred that the temperature of the beginning of transformation to martensite is neither too high nor too low, and such that the hardening effect obtained from the molybdenum is sufficient.

The invention steel also preferably comprises:

Al 1–3.5 wt. %, to provide precipitation-hardening, and to limit the risk of defects developing during hot-rolling.

The invention steel preferably does not contain titanium, the reason for this being to avoid formation of nitrides which are detrimental to fatigue strength. Less than 0.01 wt % is preferred.

Nickel, molybdenum and aluminum are preferably present according to the relationship: Ni+2.5×Mo+2.3×Al≧38 wt % to assist in providing the desired elasticity limit.

Further, the carbon content of the invention steel is preferably limited to ≦0.01 wt. %, so as to obtain a martensite which is sufficiently soft prior to aging. The remainder of the composition comprises, consists of, or consists essentially of iron, and impurities resulting from processing.

The invention steel can be prepared in the molten state, cast into ingots, and then hot-rolled, according to the state of the art. It may also be cold-rolled, e.g. to obtain a strip of thickness less than 1.5 mm. For cold-rolling, depending on the initial and desired final thicknesses, the cold-rolling may be carried out in a plurality of stages separated by annealing at temperatures ≧800° C. One may provide, in particular, that the final stage of cold-rolling represents a cold-working reduction of 0–30%. In all cases, after aging at 450–540° C., the desired mechanical characteristics are obtained. This aging treatment may be carried out either directly after the solution heat-treatment above 800° C. or after the final stage of cold rolling. The elastic limit, Re, obtained is greater than 1900 MPa and the elongation at failure is >4%.

EXAMPLES

For purposes of example, ingots designated 1–5 were produced according to the invention (see Table below). These ingots were used to prepare cold-rolled strip wherewith the final cold-rolling stage involved various percentages of reduction of thickness (A). Said final stage was preceded by intermediate annealing at 1020° C. Each ingot was used to prepare cold-rolled strips wherewith the final cold-rolling stage involved various percentage of reduction of thickness. Said final stage was preceded by intermediate annealing at 1020° C. After said final stage, the strips were hardened by aging at 510° C. for 4 hours, following which the mechanical characteristics were measured by a tensile test. For each ingot, one strip was fabricated without final cold-rolling stage, i.e. with aging directly after the intermediate annealing.

TABLE

Chemical compositions of the steels (wt. %):

| Sample | Ni | Mo | Al | C | Fe |
|---|---|---|---|---|---|
| 1 | 15 | 9.91 | 2.16 | 0.0021 | bal. |
| 2 | 17.99 | 6.75 | 2.98 | 0.0015 | Bal. |
| 3 | 17.02 | 7.86 | 1.39 | 0.002 | Bal. |
| 4 | 18.28 | 6.69 | 2.00 | 0.0071 | Bal. |
| 5 | 19.55 | 5.46 | 2.21 | 0.0047 | Bal. |

The results of the mechanical tests were as follows:

Sample 1

| Reduction | no cold rolling | 4.5% | 22.2% | 47% |
|---|---|---|---|---|
| Re(MPa) | 2237 | 2320.8 | 2392 | 2479 |
| A % | 5.82 | 4.13% | 5.53% | 3.62% |

Sample 2

| Reduction | no cold rolling | 2.9% | 26.3% | 48% |
|---|---|---|---|---|
| Re(MPa) | 2123.2 | 2140.1 | 2216.8 | 2327.8 |
| A % | 6.03% | 5.9% | 6.79% | 2.79% |

Sample 3

| Reduction | no cold rolling | 8.0 | 24.7 | 50.4 |
|---|---|---|---|---|
| Re(MPa) | 1971 | 2019 | 2068 | 2129 |
| A % | 8.11% | 8.21% | 8.49% | 7.59% |

Sample 4

| Reduction | no cold rolling | 11.1% | 28.7% | 51.57% |
|---|---|---|---|---|
| Re(MPa) | 1936 | 2038 | 2102 | 2185 |
| A % | 8.73% | 7.90% | 8.19% | 7.45% |

Sample 5

| Reduction | no cold rolling | 12% | 27.6% | 52.2% |
|---|---|---|---|---|
| Re(Mpa) | 1905 | 1986 | 2021 | 2117 |
| A % | 8.77% | 8.12% | 7.89% | 7.37% |

The results demonstrate that steels according to the invention enable one to obtain simultaneously an elastic limit >1900 MPa and an elongation at failure >4%, if the aging treatment is carried out after solution heat-treating; or if the aging treatment is carried out directly after cold working (e.g., cold-rolling) with a reduction in the range 0–30%. In certain cases, the elongation at failure was >4% even after cold working with a reduction in dimension greater than 50%. In all cases, the elastic limit was 2000 Mpa after cold working with a reduction in dimension greater than 8%.

The described maraging steels are particularly well suited to use in fabricating clock and watch parts, and conveyor belts and the like.

As noted above, the invention steels most preferably contain no added cobalt or titanium. This does not exclude trace or impurity levels of these compounds, however, which can be an inevitable result of smelting, processing, etc. and can be unintentionally added as unwanted impurities of other components. In a highly preferred embodiment care is taken to minimize or exclude titanium to the extent possible so as to avoid the deleterious formation of titanium nitrides, which are detrimental to fatigue resistance.

French patent application 98 01241 filed Feb. 4, 1998, is incorporated herein by reference.

What is claimed is:

1. A maraging steel consisting essentially of iron and, by weight based on total weight:

Ni 14–23 wt. %, Mo 4–13 wt. %,

Al 1.39–3.5 wt. %, C≦0.01 wt. %, wherein the composition of the steel also satisfies the following conditions:

Ni+Mo=23–27 wt. %;

Ni+2.5×Mo+2.3×Al≧38 wt. % and wherein the steel contains no added cobalt or titanium.

2. A maraging steel according to claim 1, wherein Mo=5–8 wt. %.

3. A maraging steel according to claim 1, wherein Ni≧16 wt. %.

4. A maraging steel according to claim 1, wherein Ni+Mo=24–26 wt. %.

5. A maraging steel according to claim 1, wherein said steel has a limit of elasticity. Re, ≧1900 MPa, and elongation at failure ≧4% for steel which has been solution heat-treated at greater than 800° C., followed directly by aging; or for steel which has been cold rolled or otherwise reduced in thickness in the range of 0–30% by cold working followed directly by aging.

6. A maraging steel according to claim 2, wherein Ni≧16 wt. %.

7. A maraging steel according to claim 2, wherein Ni+Mo=24–26 wt. %.

8. A maraging steel according to claim 3, wherein Ni+Mo=24–26 wt. %.

9. A maraging steel according to claim 2, wherein said steel has a limit of elasticity, Re, ≧2000 MPa, and elongation at failure ≧4% for steel which has been solution heat-treated at greater than 800° C., followed directly by aging; or for steel which has been cold rolled or otherwise reduced in thickness in the range of 0–30% by cold working followed directly by aging.

10. A maraging steel according to claim 3, wherein said steel has a limit of elasticity, Re, ≧2000 MPa, and elongation at failure ≧4% for steel which has been solution heat-treated at greater than 800° C., followed directly by aging; or for steel which has been cold rolled or otherwise reduced in thickness in the range of 0–30% by cold working followed directly by aging.

11. A maraging steel according to claim 4, wherein said steel has a limit of elasticity, Re, ≧2000 MPa, and elongation at failure ≧4% for steel which has been solution heat-treated at greater than 800° C., followed directly by aging; or for steel which has been cold rolled or otherwise reduced in thickness in the range of 0–30% by cold working followed directly by aging.

12. A method of making a maraging steel, the method comprising casting a molten steel, and forming the maraging steel of claim 1.

13. A maraging steel consisting of iron and, by weight based on total weight:

Ni 14–23 wt. %, Mo 4–13 wt. %,

Al 1.39–3.5 wt. %, C≦0.01 wt. %, wherein the composition of the steel also satisfies the following conditions:

Ni+Mo=23–27 wt. %; and

Ni+2.5×Mo+2.3×Al≦38 wt. %.

14. A method of making a maraging steel, the method comprising casting a molten steel, and forming the maraging steel of claim 13.

* * * * *

UNITED STATES PATENT AND TRADEMARK OFFICE

CERTIFICATE OF CORRECTION

PATENT NO. : 6,136,102

DATED : October 24, 2000

INVENTOR(S): James DAVIDSON

It is certified that an error appears in the above-identified patent and that said Letters Patent is hereby corrected as shown below:

On the Title page, Item [73], the Assignee information is spelled incorrectly. Item [73] should read as follows:

--- [73] Assignee: Imphy Ugine Precision, Puteaux, France ---

Signed and Sealed this

Fifteenth Day of May, 2001

*Attest:*

Nicholas P. Godici

NICHOLAS P. GODICI

*Attesting Officer*

*Acting Director of the United States Patent and Trademark Office*